US012006939B2

(12) United States Patent
Eser et al.

(10) Patent No.: US 12,006,939 B2
(45) Date of Patent: Jun. 11, 2024

(54) SYSTEM FOR DETECTING DRY RUNNING OF A PUMP

(71) Applicant: Vitesco Technologies GmbH, Hannover (DE)

(72) Inventors: Gerhard Eser, Munich (DE); Eugen Bernarding, Munich (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 373 days.

(21) Appl. No.: 17/283,481

(22) PCT Filed: Sep. 27, 2019

(86) PCT No.: PCT/EP2019/076307

§ 371 (c)(1),
(2) Date: Apr. 7, 2021

(87) PCT Pub. No.: WO2020/074289

PCT Pub. Date: Apr. 16, 2020

(65) Prior Publication Data

US 2021/0396235 A1 Dec. 23, 2021

(30) Foreign Application Priority Data

Oct. 8, 2018 (DE) ..... 10 2018 217 154.8

(51) Int. Cl.
*F04D 15/02* (2006.01)

(52) U.S. Cl.
CPC ..... *F04D 15/0227* (2013.01); *F04D 15/0218* (2013.01); *F04D 15/0245* (2013.01)

(58) Field of Classification Search
None
See application file for complete search history.

(56) References Cited

U.S. PATENT DOCUMENTS 2,490,827 A * 12/1949 Muller ..... G01R 27/02 324/648
2,927,048 A * 3/1960 Pritikin ..... H01C 7/00 427/101
3,424,000 A 1/1969 Chelner
3,737,886 A 6/1973 Dinges
(Continued)

FOREIGN PATENT DOCUMENTS

AU 2009302593 B2 * 5/2015 ..... E04H 4/1209
CN 202597131 U * 12/2012
(Continued)

OTHER PUBLICATIONS

Machine Translation of CN-202897131 (Obtained from USPTO Search) (Year: 2024).*
(Continued)

*Primary Examiner* — Essama Omgba
*Assistant Examiner* — Geoffrey S Lee
(74) *Attorney, Agent, or Firm* — Cozen O'Connor

(57) ABSTRACT

A system for detecting dry running of a pump includes an inlet device to an intake device of the pump for taking in an electrically conductive liquid, and an electrical resistance structure (20) arranged in the inlet device. The electrical resistance structure has a variable resistance value, dependent on wetting with the electrically conductive liquid.

15 Claims, 4 Drawing Sheets

(56) References Cited

U.S. PATENT DOCUMENTS 3,864,060 A * 2/1975 Hall, Jr. ..... F04B 49/06 73/221
3,927,563 A * 12/1975 Konomi ..... G01F 1/785 73/861.59
4,311,438 A * 1/1982 Comstedt ..... F04B 49/02 968/802
4,325,894 A * 4/1982 Date ..... F02M 17/02 261/DIG. 50
4,388,043 A * 6/1983 Preiss ..... F04B 49/10 324/448
4,392,782 A * 7/1983 Kuehn, III ..... G05D 9/12 307/118
4,507,053 A * 3/1985 Frizzell ..... F04B 49/02 417/43
5,238,369 A * 8/1993 Farr ..... G01F 23/265 417/18
5,245,946 A * 9/1993 Hoefelmayr ..... G01F 1/64 119/14.17
5,672,050 A * 9/1997 Webber ..... F04D 15/0218 417/18
5,757,197 A * 5/1998 O'Neill ..... G01F 23/24 324/696
5,792,964 A 8/1998 van den Berg
6,547,529 B2 * 4/2003 Gross ..... F04D 15/0218 417/4
8,380,355 B2 * 2/2013 Mayleben ..... G01F 23/268 700/282
8,397,525 B2 * 3/2013 Chauvin ..... F04B 49/02 73/304 C
10,634,146 B2 * 4/2020 Correia ..... F04D 15/0072
2002/0131866 A1 * 9/2002 Phillips ..... F04B 49/065 417/36
2003/0039549 A1 * 2/2003 Gross ..... F04D 15/0218 417/36
2003/0221674 A1 * 12/2003 Scanderbeg ..... F02D 41/406 123/479
2007/0006646 A1 * 1/2007 Vargas Da Silva ..... G01F 23/24 73/304 R
2010/0310382 A1 * 12/2010 Kidd ..... F04D 15/0088 417/44.1
2013/0108479 A1 5/2013 Branecky
2014/0212264 A1 * 7/2014 Zimmerman ..... F04D 13/10 415/8

FOREIGN PATENT DOCUMENTS

CN 103796802 5/2014
CN 104009513 8/2014
CN 107850499 3/2018
DE 16 48 062 3/1971
DE 2 946 858 7/1980
DE 2 925 830 1/1981
DE 29 504 606 7/1995
DE 101 01 099 7/2002
DE 696 29 612 6/2004
DE 10 2016 005 467 11/2017
EP 733884 A1 * 9/1996 ..... A01J 5/01
EP 1 762 263 3/2007
GB 2568284 A * 5/2019 ..... F04D 15/0218
NL 9500566 11/1996

OTHER PUBLICATIONS

Office Action dated May 18, 2022 issued in Chinese Patent Application No. 201980064725.8.
International Search Report issued in corresponding PCT Application PCT/EP2019/076307.
Written Opinion issued in corresponding PCT Application PCT/EP2019/076307.
Office Action issued in corresponding DE Application No. 10 2018 217 154.8.

* cited by examiner

SYSTEM FOR DETECTING DRY RUNNING OF A PUMP

CROSS REFERENCE TO RELATED APPLICATIONS

This is a U.S. national stage of International application No. PCT/EP2019/076307, filed on Sep. 27, 2019, which claims priority to German Application No. 10 2018 217 154.8, filed Oct. 8, 2018, the content of each of which is incorporated herein by reference.

BACKGROUND OF THE INVENTION

1. Field of the Invention

The invention relates to a system for detecting dry running of a pump. The invention also relates to a pump, in particular a coolant pump, with detection of dry running of the pump. The invention also relates to a method for detecting dry running of a pump.

2. Description of the Prior Art

A pump is used in a wide range of application areas, for example as a coolant pump for cooling system components. In modern internal combustion engines or electric vehicles, for example, thermal management of the electric drive and its components or the battery is necessary. A coolant that flows past the temperature-sensitive components is used for cooling. The coolant flow is provided by a coolant pump. Due to the mechanical properties of the coolant pump, dry running of the pump should be avoided as far as possible in order to avoid damage to the pump assemblies.

SUMMARY OF THE INVENTION

The pump design of the coolant pump may be configured in such a way that the pump can survive dry running for a certain minimum time without mechanical damage to its components. This can be achieved, for example, through the design of the pump, for example the design of the bearings.

It is desirable to specify a system for detecting dry running of a pump, in particular a coolant pump, which makes it possible to reliably detect dry running of the pump. Also to be specified is a pump, in particular a coolant pump, with detection of dry running of the pump, which makes it possible to reliably detect dry running of the pump, with the manufacturing complexity being limited and the pump therefore being inexpensive to manufacture. Another concern of the present invention is to provide a method for detecting dry running of a pump with which dry running of the pump can be reliably detected.

In one aspect of the invention, a system for detecting dry running of a pump comprises an inlet device for feeding an electrically conductive liquid to an intake device of the pump. Furthermore, the system comprises an electrical resistance structure, which is arranged in the inlet device. The electrical resistance structure has a variable resistance value, dependent on wetting with the electrically conductive liquid.

In order to detect whether an (electrically conductive) liquid is present in the inlet device, for example a meandering structure of the conductor track can be arranged in the inlet device. The electrically conductive structure may be configured such that the electrically conductive structure has a low resistance value when wetted with the electrically conductive liquid. In the opposite case, if there is no wetting with the electrically conductive liquid, the electrically conductive structure has a higher resistance value.

The electrical resistance structure is in particular an electrical conductor track structure.

According to one possible embodiment, the resistance structure may have low-resistance conductor track sections, between which high-resistance conductor track sections are arranged. The low-resistance conductor track sections may for example be arranged along the flow side of the pump or parallel to the direction of flow of a liquid into the pump. Electrical connections or conductor track sections with higher resistance may be arranged transversely or at right angles to the low-resistance conductor track sections. The conductor track sections made of the high-resistance electrically conductive material may for example be arranged transversely to the direction of flow, while the conductor track sections made of the low-resistance electrically conductive material are arranged in the direction of flow of the liquid.

The system may also have an evaluation circuit for determining the resistance value of the resistance structure. According to one possible embodiment, the resistance structure may be configured such that the resistance structure has a high resistance value when the resistance structure is not wetted by the electrically conductive liquid or when there is no electrically conductive liquid in the inlet device on the suction side of the pump. If the resistance structure is wetted by an electrically conductive liquid, the high-resistance connections or conductor track sections of the resistance structure are bridged with low resistance, so that the resistance value of the resistance structure drops.

The evaluation circuit can thus detect potential dry running of the coolant pump when it is determined by logic in the evaluation circuit that the resistance structure has a high resistance value. Conversely, the wetting of the resistance structure with the electrically conductive liquid can be detected when it is established by the evaluation circuit that the resistance structure has a low resistance value.

An embodiment of a pump, in particular a coolant pump, with detection of dry running of the pump is specified below.

The pump comprises a system for detecting dry running of the pump, wherein the inlet device is arranged on a suction side of the pump.

A method for detecting dry running of a pump is specified below.

A system for detecting dry running of the pump is used to carry out the method. First, a resistance value of the resistance structure of the pump is determined. The determined resistance value of the resistance structure is compared with a resistance threshold value. The pump is found to be running dry if it is established in the comparison that the determined resistance value of the resistance structure is above the resistance threshold value.

BRIEF DESCRIPTION OF THE DRAWINGS

The invention is explained in more detail below on the basis of figures which show exemplary embodiments of the present invention, in which.

DETAILED DESCRIPTION OF THE PRESENTLY PREFERRED EMBODIMENTS

A system 1 for detecting dry running of a pump, in particular a coolant pump, comprises an inlet device 10 for feeding an electrically conductive liquid to an intake device of a pump. Furthermore, the system 1 comprises an electrical resistance structure 20, which is arranged in the inlet device 10. The electrical resistance structure 20 has a variable resistance value, dependent on wetting with the electrically conductive liquid.

The resistance structure 20 may, for example, be configured such that the resistance structure has a first resistance value when it is wetted with the electrically conductive liquid and a second resistance value when it is not wetted with the electrically conductive liquid. The first resistance value is, for example, smaller than the second resistance value. This means that the resistance structure has a lower resistance value in the case of wetting with the electrically conductive liquid than when there is no electrically conductive liquid in the inlet device 10 and the resistance structure 20 is therefore not wetted.

Figure 1:
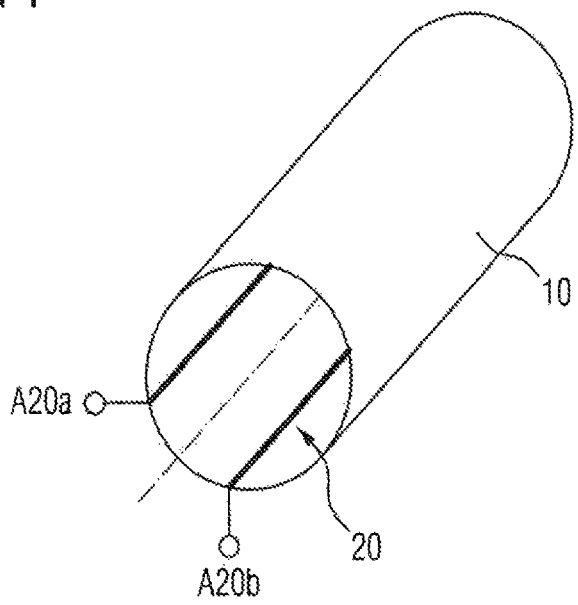
FIG. 1 shows an embodiment of a system for detecting dry running of a pump.
Figure 2A:
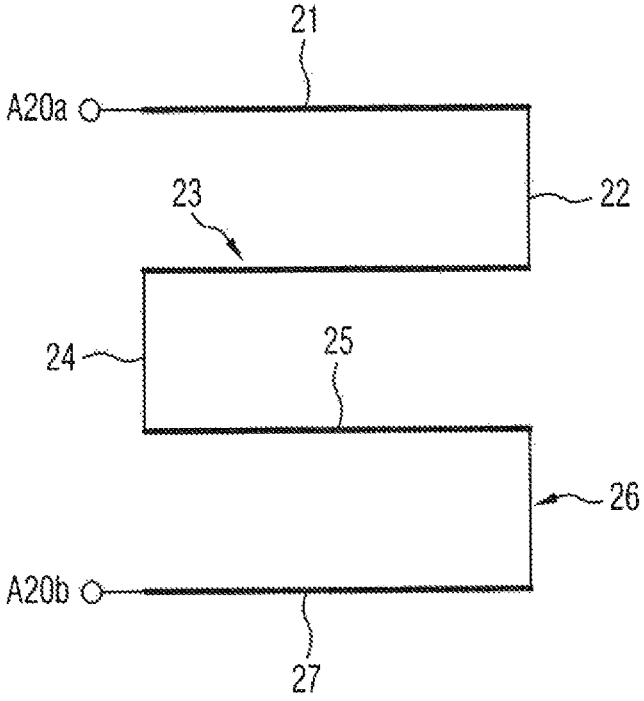
FIG. 2A shows an embodiment of an electrical resistance structure of a system for detecting dry running of a pump.

FIG. 2A shows a possible embodiment of the electrical resistance structure 20, which is arranged in the interior of the inlet device 10. The resistance structure 20 has a first terminal A20*a* and a second terminal A20*b* for tapping off a voltage. Between the first and the second terminal A20*a* and A20*b*, the resistor structure 20 has at least one conductor track section made of a first material and at least one further conductor track section made of a second material. The first material may, for example, have a higher electrical conductivity than the second material or the first material may be a low-resistance electrically conductive material, while the second material is a high-resistance electrically conductive material.

The resistance structure 20 may be arranged in a meandering form between the first terminal A20*a* and the second terminal A20*b*. The at least one conductor track section made of the first material and the at least one further conductor track section made of the second material may, for example, be arranged at right angles to one another. The resistance structure 20 may in particular be arranged in the inlet device 10 such that the at least one conductor track section made of the first material runs in the longitudinal direction of the inlet device 10 and the at least one further conductor track section made of the second material runs transversely to the longitudinal direction of the intake pipe 10.

In the meandering configuration of the resistance structure 20 shown in FIG. 2A, the resistance structure 20 comprises the conductor track sections 21 to 27. The conductor track sections 21, 23, 25 and 27 comprise a material with a high electrical conductivity (electrically low-resistance material), while the conductor track sections 22, 24 and 26 comprise a material with a low electrical conductivity (electrically high-resistance material).

The resistance structure 20 may be arranged in the inlet device 10 such that the conductor track sections 21, 23, 25 and 27 are arranged in the direction of flow of the electrically conductive liquid or in the longitudinal direction of the inlet device 10. The conductor track sections 22, 24 and 26 are arranged transversely to the direction of flow or transversely/at right angles to the longitudinal direction of the inlet device 10.

According to a simple embodiment of the resistance structure, the resistance structure 20 may have between the first and the second terminal A20*a* and A20*b* a first conductor track section made of the first material, a second conductor track section made of the second material and a third conductor track section made of the first material. The first conductor track section may be arranged between the first terminal A20*a* and the second conductor track section. The third conductor track section may be arranged between the second terminal A20*b* and the second conductor track section. The second conductor track section may be arranged between the first conductor track section and the third conductor track section. In this simplified embodiment, the resistance structure 20 comprises two conductor track sections made of a low-resistance, electrically conductive material and one conductor track section made of a high-resistance, electrically conductive material.

Figure 2B:
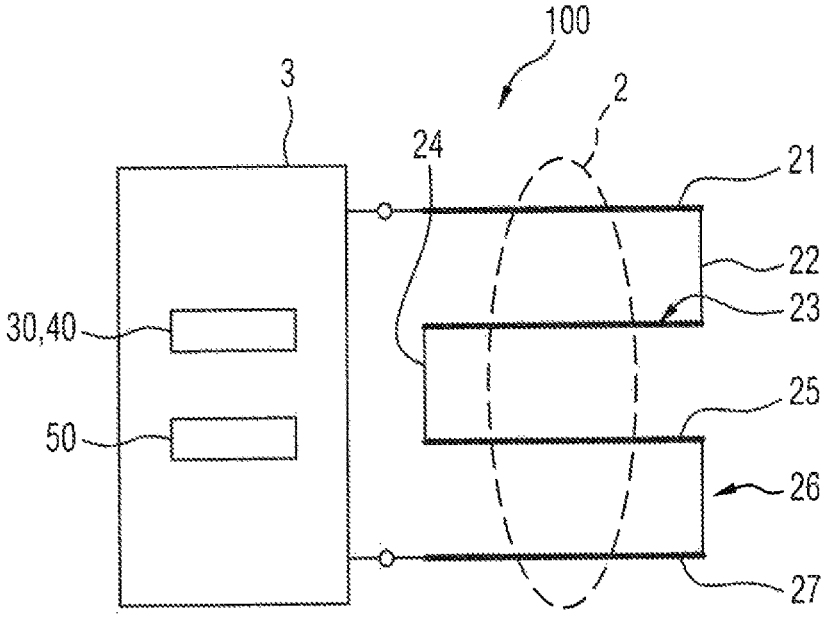
FIG. 2B shows an embodiment of a system for detecting dry running of a pump with an evaluation circuit.

FIG. 2B shows a further embodiment of a system 1 for detecting dry running of a pump. In the illustration in FIG. 2B, the resistance structure 20 is configured as in FIG. 2A. It is pointed out that the resistance structure 20 may have more or fewer conductor track sections. The system 1 is not limited to the illustrated meandering configuration of the resistance structure 20.

In the illustration of the system 1 in FIG. 2B, the resistance structure 20 is wetted by an electrically conductive liquid 2. The electrically conductive liquid 2 bridges the high-resistance conductor track sections 22, 24 and 26 in an electrically low-resistance manner, so that the resistance value of the resistance structure 20 decreases in comparison with a case in which the resistance structure 20 is not wetted by the liquid 2.

The system 1 for detecting dry running of a pump comprises an evaluation circuit 3 for determining the resistance value of the resistance structure 20. The evaluation circuit 3 can be connected to the first and second terminals A20*a* and A20*b* of the resistance structure 20. The evaluation circuit 3 is configured to detect dry running of the coolant pump when the evaluation circuit determines the above-specified second resistance value, for example a high resistance value, between the first terminal A20*a* and the second terminal A20*b* of the resistance structure 20. If, on the other hand, the evaluation circuit 3 determines the above-mentioned first resistance value, for example a low resistance value, between the first and second terminals A20*a* and A20*b* of the resistance structure 20, the resistance structure 20, as shown in FIG. 2B, is wetted by the electrically conductive liquid 2.

On the basis of a resistance measurement between the first terminal A20*a* and the second terminal A20*b* of the resistance structure 20, the evaluation circuit 3 can thus determine whether the electrically conductive liquid 2 is in the inlet device to the pump or whether the pump is running dry.

The evaluation circuit 3 may furthermore be configured to determine a fault, for example a line break, within the resistance structure 20. If the resistance structure 20 is not wetted by an electrically conductive liquid, with an intact resistance structure 20 a small current nevertheless flows through the individual interconnected conductor track sections. If, on the other hand, one of the conductor track sections is broken, no current is detected by the evaluation circuit 3 when a voltage is applied between the first terminal A20*a* and the second terminal A20*b*.

Figure 3:
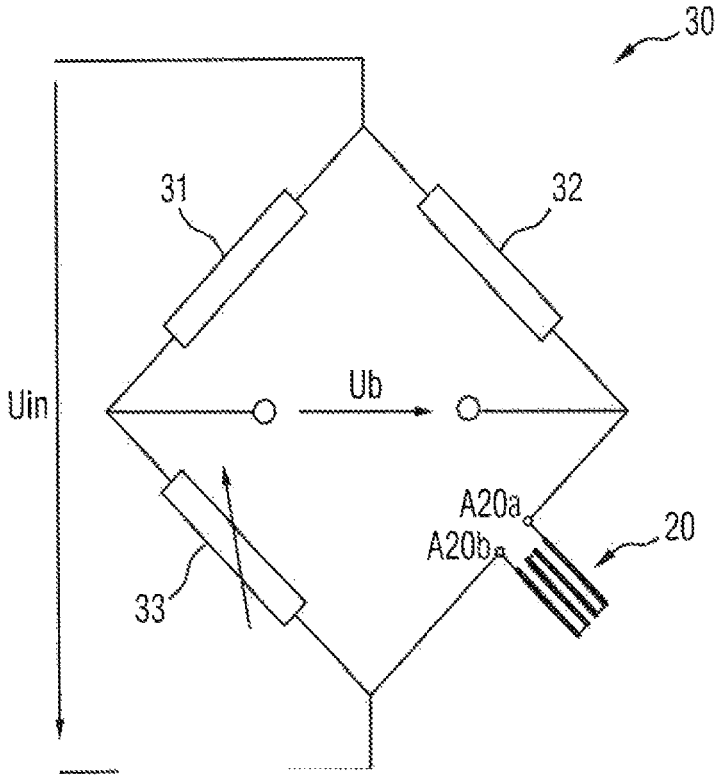
FIG. 3 shows an embodiment of a Wheatstone measuring bridge for determining a resistance value of an electrical resistance structure.

The evaluation circuit 3 may for example have a Wheatstone measuring bridge 30 or an operational amplifier circuit 40. FIG. 3 shows a possible configuration of a Wheatstone measuring bridge 30 for determining the resistance value of the resistance structure 20 between the first terminal A20*a* and the second terminal A20*b*. In the Wheatstone measuring bridge 30, the resistors 31 and 32 are specified with fixed resistance values, while the resistor 33 is a variable resistor. When a supply voltage Uin is applied to the Wheatstone measuring bridge 30, the variable resistor 33 is varied, for example until the bridge voltage/measuring voltage Ub is approximately 0 V. If the resistance value of the resistance structure 20 changes due to wetting with the electrically conductive liquid or due to a lack of wetting by the electrically conductive liquid, a change occurs in the measurement voltage/bridge voltage Ub, which allows a conclusion to be drawn about the resistance value of the resistance structure 20.

Figure 4:
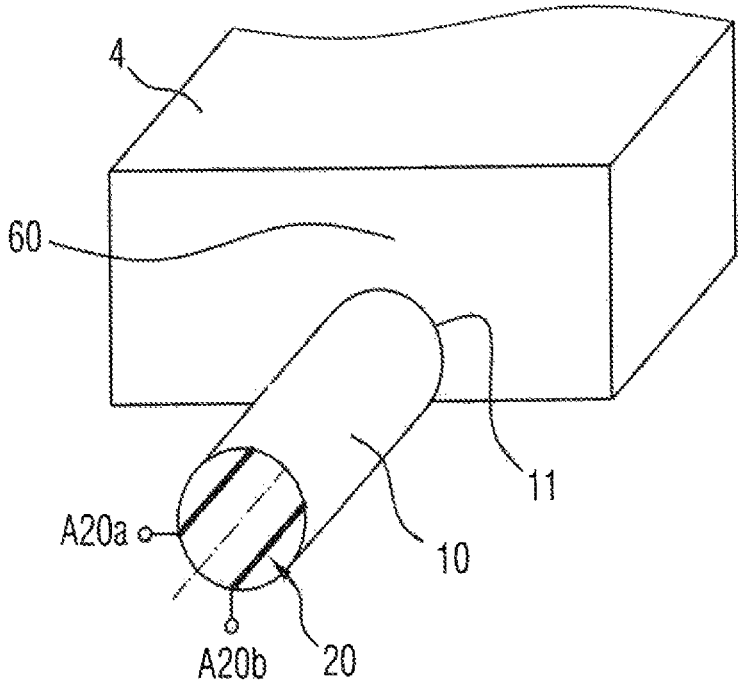
FIG. 4 shows an embodiment of a pump with detection of dry running of the pump.

FIG. 4 shows a pump 4, in particular a coolant pump, with detection of dry running of the pump. The pump 4 comprises one of the embodiments described above of the system for detecting dry running of the pump. The inlet device 10 is for example arranged on a suction side 11 of the pump 4. The inlet device 10 serves for feeding an electrically conductive liquid to an intake device 60 of the pump for taking in the electrically conductive liquid. The inlet device 10 may be configured as a coupling piece/adapter for coupling a line to the pump 4 or as an intake pipe of the pump. The resistance structure 20 may, for example, be arranged on the inner walls of the inlet device 10. The electrical resistance structure 20 has a variable resistance value, dependent on wetting with the electrically conductive liquid.

A method for detecting dry running of the pump 1 is specified below. A resistance value of the resistance structure 20 of the pump 1 is determined by the resistance structure 20 and the evaluation circuit 3 connected to it. The evaluation circuit 3 compares the determined resistance value of the resistance structure 20 with a resistance threshold value. If it is established in the comparison that the determined resistance value of the resistance structure 20 is above the resistance threshold value, dry running of the coolant pump 1 can be established.

Figure 5:
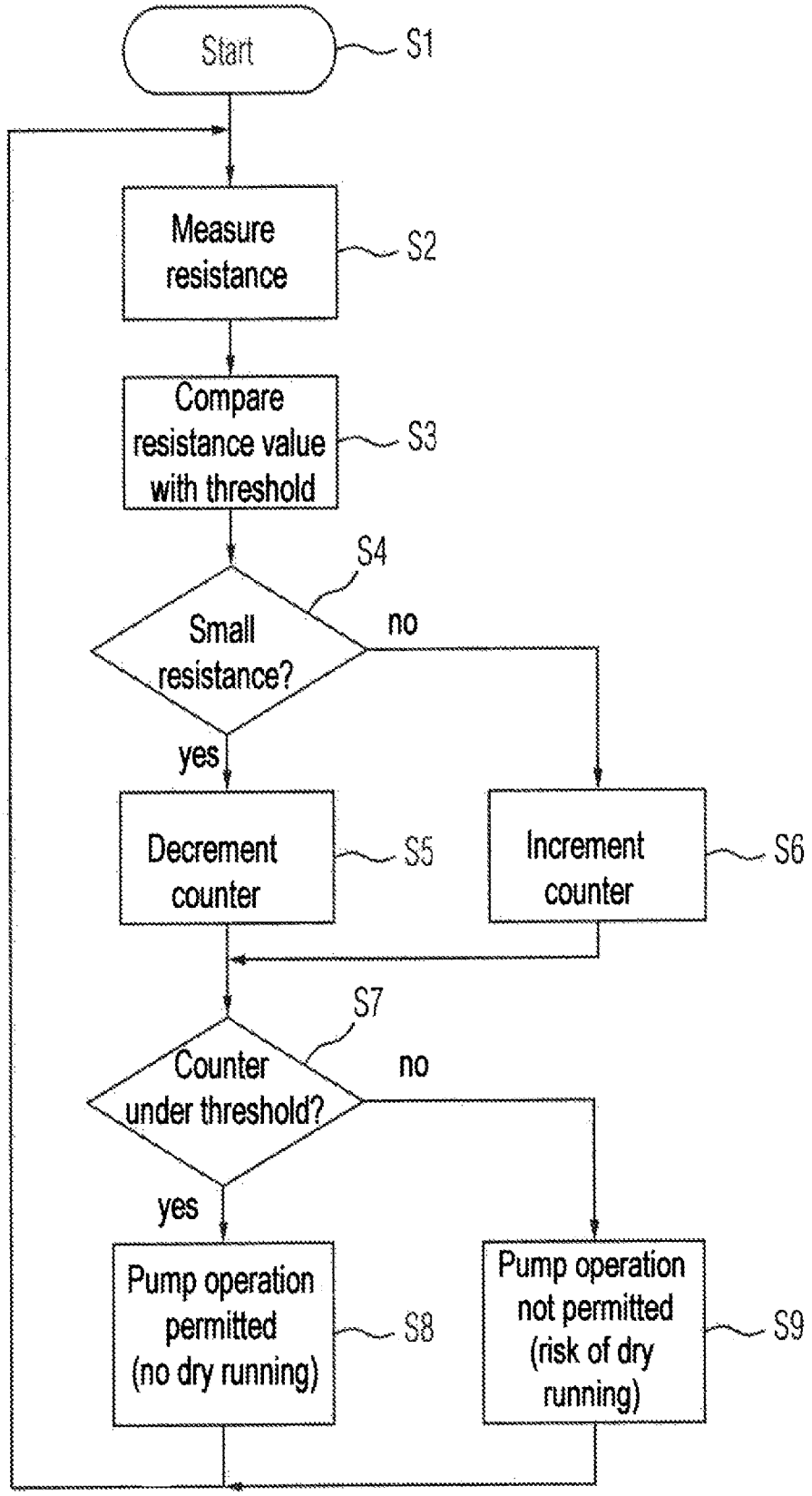
FIG. 5 shows a flow diagram for a method for detecting dry running of a pump.

FIG. 5 shows a flow diagram of a method for determining dry running of a pump with debouncing of the input signal in order to avoid disturbances in operation due to temporary effects.

For carrying out the method, the evaluation circuit 3 has a counter circuit 50 (FIG. 2B) for incrementing and decrementing a counter reading of the counter circuit 50. The evaluation circuit 3 is configured in particular to decrement or increment the counter reading of the counter circuit 50, dependent on whether the determined resistance value is above or below the resistance threshold value. Furthermore, the evaluation circuit 3 is configured to determine whether the counter reading of the counter circuit 50 is above or below a counter reading threshold value. Furthermore, the evaluation circuit 3 is configured to determine whether the pump 4 is running dry, dependent on whether the counter reading of the counter circuit 50 is above or below the counter reading threshold value. The evaluation circuit 3 is configured in particular to end operation of the pump 4 if dry running of the pump 4, that is to say a high resistance value of the resistance structure 20, has been established.

At the beginning of the method in step S1, the counter of the counter circuit is set to an initial state/initial counter reading. In step S2, the resistance value of the resistance structure 20 is measured between the first terminal A20*a* and the second terminal A20*b*. In step S3, the previously determined resistance value is compared with the resistance threshold value. In step S4, it is decided whether the resistance value is small or large, that is to say it is below or above the resistance threshold value.

Then, dependent on whether the determined resistance value is above or below the resistance threshold value, the counter reading of the counter circuit 50 is then incremented or decremented (method steps S5 and S6). The evaluation circuit 3 is thus configured to change the counter reading of the counter circuit 50 starting from an initial counter reading. The initial counter reading may be below the counter reading threshold value.

In particular in the case of the exemplary sequence of the method shown in FIG. 5, the counter reading of the counter circuit 50 is decremented if it has been established in method step S4 that the measured resistance value of the resistance structure 20 is small and thus the resistance structure 20 is presumably wetted by the electrically conductive liquid. If, on the other hand, it is determined in step S4 that the resistance value of the resistance structure 20 is large, in particular above the resistance threshold value, the counter reading of the counter circuit 50 is incremented in method step S6.

According to one possible embodiment, the evaluation circuit 3 may thus be configured to decrement a counter reading of the counter circuit 50 if the determined resistance value is below the resistance threshold value. Furthermore, the evaluation circuit 3 may be configured to increment the counter reading of the counter circuit 50 if the determined resistance value is above the resistance threshold value.

In method step S7, it is determined whether the current counter reading of the counter circuit 50 is above or below the counter reading threshold value. Dependent on whether the counter reading of the counter circuit 50 is above or below the counter reading threshold value, dry running of the pump 4 can be established (method steps S8 and S9). If for example it is established that the counter reading of the counter circuit 50 is below the counter reading threshold value, it can be concluded that the resistance structure 20 is wetted by the electrically conductive liquid, and therefore there is no dry running. In this case, operation of the pump is permitted (step S8). If, on the other hand, it is established in method step S7 that the counter reading is above the counter reading threshold value, there is a risk of dry running. In this case, the operation of the pump is not permitted and the operation of the coolant pump is ended in method step S9 in order to prevent damage to the pump.

The evaluation circuit 3 is thus configured to establish dry running of the pump 4 and to end operation of the pump 4 if the evaluation circuit 3 establishes that the counter reading of the counter circuit 50 is below the counter reading threshold value.

The method is carried out permanently. The specified test algorithm can therefore be used to test whether the pump is running dry. The test algorithm can avoid short-term disturbances in the input measurement, since dry running is only detected if the current counter reading is above the counter reading threshold value.

Another advantage of the method shown in FIG. 5 is the possibility of a test run of the pump. If the initial counter reading of the counter circuit 50 has a low value below the counter reading threshold value, the pump initially runs dry, even if it is established in method step S4 that the measured resistance value is large compared to the resistance threshold value. Dry running of the pump continues until the initial state of the counter has been increased in method step S6 to such an extent that the current counter reading is above the counter reading threshold value.

Although exemplary embodiments have been discussed in the above description, it should be noted that numerous modifications are possible. Furthermore, it should be noted that the exemplary embodiments are merely examples which are not intended to limit the scope of protection, the applications and the structure in any way. Rather, a person skilled in the art will take from the above description a guideline for implementation of at least one exemplary embodiment, wherein various modifications may be made, in particular with regard to the function and arrangement of the described components, without departing from the scope of protection as can be gathered from the claims and equivalent feature combinations.

The invention claimed is:

1. A system which detects dry running of a pump, the system comprising:

an inlet device which feeds an electrically conductive liquid to an intake device of the pump for taking in the electrically conductive liquid; and an electrical resistance structure arranged entirely within the inlet device;

wherein the electrical resistance structure has a variable resistance value which is dependent on wetting with the electrically conductive liquid;

wherein the electrical resistance structure has a first and a second terminal configured to tap off a voltage; and wherein the electrical resistance structure arranged entirely within the inlet device has, arranged in series between the first and the second terminal, at least one conductor track section made of a first material and at least one further conductor track section made of a second material.

2. The system as claimed in claim 1, wherein the resistance structure is configured such that the resistance structure has a first resistance value when wetted with the electrically conductive liquid and a second resistance value when not wetted with the electrically conductive liquid; and wherein the first resistance value is smaller than the second resistance value.

3. The system as claimed in claim 1, wherein the first material has a higher electrical conductivity than the second material.

4. The system as claimed in claim 3, wherein the resistance structure is arranged in a meandering form between the first and the second terminals.

5. The system as claimed in claim 4, wherein the electrical resistance structure is arranged in the inlet device such that the at least one conductor track section extends longitudinally within the inlet device and the at least one further conductor track section extends transversely to a longitudinal direction of the inlet device.

6. The system as claimed in claim 5, comprising:

an evaluation circuit which determines the resistance value of the electrical resistance structure; and wherein the evaluation circuit detects dry running of the pump when the evaluation circuit determines the second resistance value between the first and the second terminals of the electrical resistance structure.

7. The system as claimed in claim 6, wherein the evaluation circuit has a Wheatstone measuring bridge or an operational amplifier circuit.

8. The system as claimed in claim 7, wherein the evaluation circuit has a counter circuit for incrementing and decrementing a counter reading of the counter circuit;

wherein the evaluation circuit decrements or increments the counter reading of the counter circuit, dependent on whether the determined resistance value is above or below a resistance threshold value;

wherein the evaluation circuit determines whether the counter reading of the counter circuit is above or below a counter reading threshold value; and wherein the evaluation circuit determines dry running of the pump, dependent on whether the counter reading of the counter circuit is above or below the counter reading threshold value, and terminates operation of the pump if dry running of the pump has been established.

9. The system as claimed in claim 8, wherein the evaluation circuit decrements a counter reading of the counter circuit if the determined resistance value is below the resistance threshold value, and increments the counter reading of the counter circuit if the determined resistance value is above the resistance threshold value; and wherein the evaluation circuit determines dry running of the pump and terminates operation of the pump if the evaluation circuit establishes the counter reading of the counter circuit is below the counter reading threshold value.

10. The system as claimed in claim 9, wherein the evaluation circuit changes the counter reading of the counter circuit starting from an initial counter reading which is below the counter reading threshold value.

11. A method for detecting dry running of a pump, comprising:

providing the system for detecting dry running of the pump according to claim 8;

determining a resistance value of the electrical resistance structure;

comparing the determined resistance value of the electrical resistance structure with a resistance threshold value; and finding that the pump is running dry if, upon establishing during said comparing, the determined resistance value of the electrical resistance structure is above the resistance threshold value.

12. The method as claimed in claim 11, further comprising:

decrementing or incrementing the counter reading of the counter circuit, dependent on whether the determined resistance value is above or below the resistance threshold value;

determining whether the counter reading of the counter circuit is above or below the counter reading threshold value;

establishing dry running of the pump, dependent on whether the counter reading of the counter circuit is above or below the counter reading threshold value; and ending operation of the pump if dry running of the pump has been established.

13. The method as claimed in claim 12, further comprising:

changing the counter reading of the counter circuit starting from an initial counter reading which is being below the counter reading threshold value.

14. A pump formed as a coolant pump which includes detection of dry running of the pump, comprising:

the system which detects dry running of the pump according to claim 1; and the inlet device being arranged on an intake side of the pump.

15. The pump as claimed in claim 14, wherein the inlet device is configured as a coupling piece for coupling a line to the pump or is configured as an intake pipe of the pump.

* * * * *